United States Patent [19]

Novak et al.

[11] 4,320,864

[45] Mar. 23, 1982

[54] MUFFLER FOR FASTENER DRIVING TOOL

[75] Inventors: Raymond F. Novak, Itasca; Bernard W. Geist, Melrose Park, both of Ill.

[73] Assignee: Duo-Fast Corporation, Franklin Park, Ill.

[21] Appl. No.: 152,198

[22] Filed: May 22, 1980

[51] Int. Cl.[3] ..... B25C 1/04; B25C 9/00; F01N 1/10

[52] U.S. Cl. ..... 227/130; 173/DIG. 2; 181/230; 181/258; 227/156

[58] Field of Search ..... 91/55; 173/DIG. 2; 181/230, 258; 227/130, 156

[56] References Cited

U.S. PATENT DOCUMENTS

| | | | |
|---|---|---|---|
| 3,981,378 | 9/1976 | Potter | 173/DIG. 2 X |
| 4,102,357 | 7/1978 | Charlton | 181/258 X |
| 4,113,052 | 9/1978 | McElroy, Jr. | 181/230 |
| 4,117,767 | 10/1978 | Elliesen | 227/130 X |
| 4,149,862 | 4/1979 | Sewell, Sr. | 181/258 X |
| 4,205,732 | 6/1980 | Auerbach et al. | 181/230 |

*Primary Examiner*—Paul A. Bell

*Attorney, Agent, or Firm*—Mason, Kolehmainen, Rathburn & Wyss

[57] ABSTRACT

A tool for driving fasteners includes a housing defining a handle portion and a nose portion. A driver is reciprocally mounted within the housing as is an assembly for driving the driver through a fastener driving stroke. A muffler is mounted in the housing adjacent and in fluid communication with the nose portion. The muffler includes a chamber defined within the housing and a tubular muffler element mounted within the chamber. The tubular muffler element includes a plurality of holes therein and communicates with at least one exhaust port. A second muffler element is mounted within the chamber and encircles the tubular muffler element.

13 Claims, 3 Drawing Figures

FIG. 1
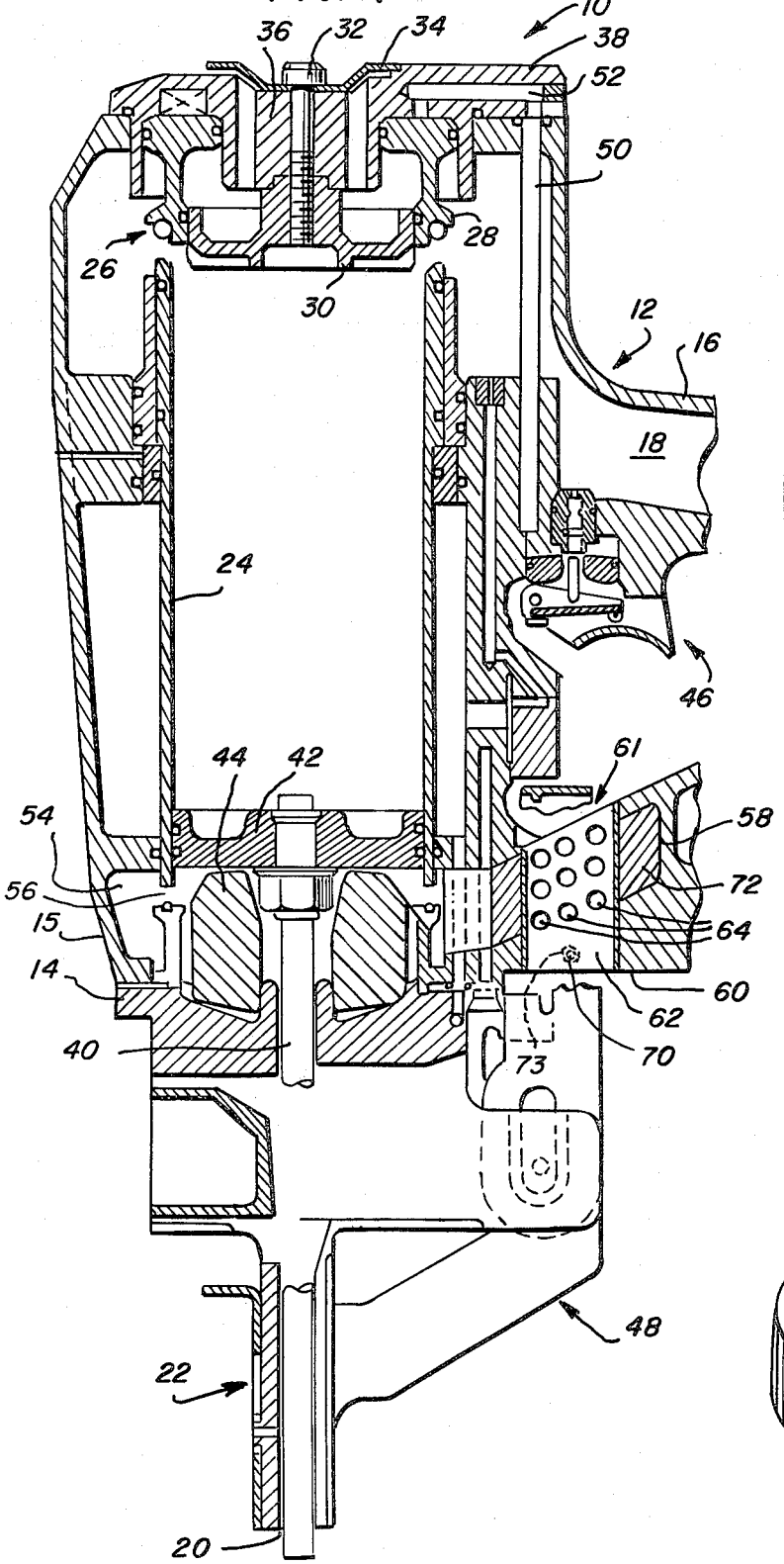
FIG. 2
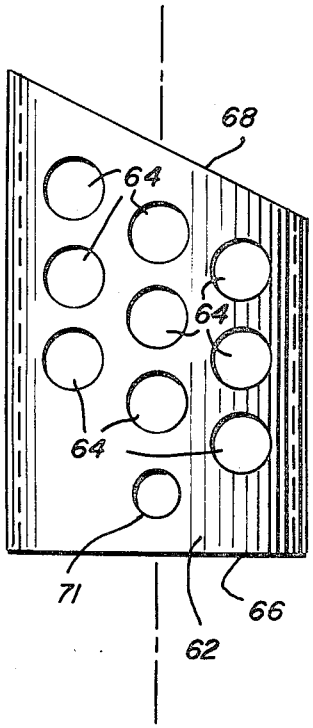
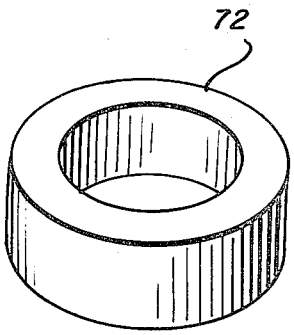
FIG. 3

MUFFLER FOR FASTENER DRIVING TOOL

BACKGROUND OF THE INVENTION

A. Field of the Invention

The present invention relates to a new and improved muffler for a tool employed for driving fasteners into a workpiece.

B. Description of the Prior Art

Most prior art tools employed for driving fasteners into a workpiece are powered by compressed fluids such as pressurized air. The typical prior art tool includes a nose portion within which a piston is mounted and secured to a driver for driving fasteners. Compressed air is introduced above the piston to power the driver through a driving stoke. The air below the piston during the driving stroke is not exhausted but is contained within a reservoir and compressed under the influence of the downward moving piston. At the completion of the downward stroke of the driver, the air forced into the reservoir is released allowing this air to return the driver and piston to the original position. There is, however, an exhaust port located at the upper end of the piston chamber of the tool that allows escape of the air above the piston to pass to the atmosphere. A muffler may be included in this upper exhaust port that is a porous bronze or a beaded plastic member through which the air passes to muffle the noise.

In such prior art tools, there is no need for a lower muffler to muffle the noise created by, for example, the engagement of the piston with a bumper located at the lower end of the nose portion and The noise created by the compressed air being compressed by the downward moving piston and driver during a driving stroke; however, there are prior art tools that do not employ the air below the piston to return the driver to the static position. These latter tools exhaust the air below the piston to the atmosphere.

The typical prior art muffler employed in the upper exhaust ports allow air to pass into the center of the muffler and to dispense or disburse radially outward through the muffler element. It is desirable to employ a muffler in the exhaust of tools exhausting air below the piston and to employ a muffler that is an improvement of the prior art muffler employed in the upper exhaust ports of prior art tools.

SUMMARY OF THE INVENTION

An object of the present invention is to provide a new and improved muffler for a fastener driving tool.

Another object of the present invention is to provide a new and improved muffler for muffling the noise created by a fastener driving tool during the driving stroke.

A further object of the present invention is to provide a new and imporoved muffler for a fastener driving tool that operates in reverse to known prior art mufflers by introducing the sound carrying exhaust around the outer periphery of the muffler and passing the exhaust through the muffler into the interior thereof and passing the muffled exhaust out the axial ends of the muffler.

The present invention is directed to a new and improved muffler for a fastener driving tool. The fastener driving tool includes a housing defining a handle portion and a nose portion. A cylinder is defined within the nose portion within which is reciprocally mounted a piston and a fastener driver attached thereto. The tool further includes an assembly for driving the piston and the driver downward through a fastener driving stroke.

The tool is of the type that exhausts the air beneath the piston during the fastener driving stoke. The lower end of the nose portion of the tool beneath the piston is in fluid communication with a chamber defined in the housing of the tool. A first tubular muffler element is mounted within the chamber and includes a plurality of holes therethrough such that exhaust air entering the chamber encircles the tubular muffler and passes through the openings. The axial ends of the tubular muffler are in fluid communication with an exhaust port in the housing such that once the exhaust air passes into the interior of the tubular muffler, it may then flow through either end of the tubular muffler and out exhaust ports.

The muffler may also include a second annular muffler element encircling the tubular muffler element such that the exhaust air within the chamber must first pass through the annular muffler element and then through the tubular muffler element before escaping to the atmosphere.

BRIEF DESCRIPTION OF THE DRAWING

The above and other objects and advantages and novel features of the present invention will become apparent from the following detailed description of the peferred embodiment of the invention illustrated in the accompanying drawing wherein:

FIG. 1 is a vertical cross-sectional view of a fastener driving tool at the completion of a driving stroke including a muffler constructed in accordance with the principles of the present invention;

FIG. 2 is an enlarged view of a tubular muffler element of the muffler of the present invention; and FIG. 3 is an enlarged perspective view of a second, annular muffler element included in the muffler of the present invention.

DESCRIPTION OF THE PREFERRED EMBODIMENT

The muffler of the present invention is herein described as being employed in a fastener driving tool of the type that exhausts air below the fastener driving piston to the atmosphere; however, it is to be understood that the muffler of the present invention may also be used in a tool that exhausts air above the piston through the top of the tool housing. In addition, the specific configuration of the muffler as herein described is not intended to limit the configurations of mufflers that may be employed and is only being used as an illustrative example.

Referring first to FIG. 1 of the drawing, a tool 10 is illustrated that is similar to the tool described in U.S. Pat. application Ser. No. 090,009 filed on Oct. 31, 1979 and assigned to the assignee of the present invention. The tool 10 is only illustrative of the type of tools in which the muffler of the present invention may be employed and, therefore, is only described generally. For a more complete description of the tool of the present invention, reference is made to the above-identified application that is herein incorporated by reference.

The tool 10 is of the pneumatic type defined by a casing or housing generally designated by the reference numeral 12 that defines a nose portion 14 and a handle portion 16. The interior of the handle portion 16 defines a fluid reservoir 18 that is connected to a source of high pressure fluid. Coupled to the tool 10 is a magazine assembly (not shown) that contains a plurality of fasteners that are fed to a drive track 20 defined in a drive track portion 22 depending from the nose portion 14.

Mounted within the housing 12 is a cylinder 24 that in the static mode engages a poppet assembly generally designated by the reference numeral 26. The poppet assembly 26 includes a poppet 28 biased by springs or other means (not shown) to a downward position to engage the upper end of the cylinder 24. Also mounted within the poppet 28 is an exhaust seal 30 that is connected by bolt 32 to an exhaust deflector 34. The exhaust seal 30 and the deflector 34 are separated by a spacer portion 36 of a cap 38 mounted on the bolt 32. The cap 38 is secured to the upper end of the housing 12 and closes off that portion of the housing 12 containing the poppet assembly 26. It is at this location that an upper muffler such as the muffler of the present invention may be included; however, for the tool 10 of the present invention, the muffler assembly is disclosed as located in a position for muffling noise carried by the air being exhausted from the nose portion 14 of the tool 10.

The tool 10 further includes a driver 40 mounted within the cylinder 24 and coupled to a driver piston 42 that in the static mode of the tool, engages the poppet 28 and at the completion of a driving stroke engages a bumper 44 secured to the nose portion 14. The driver 40 extends downward through the drive track 20 to engage fasteners fed by the magazine assembly driving them into a workpiece.

The tool 10 also includes a trigger assembly generally designated by the reference numeral 46 and a safety assembly generally designated by the reference numeral 48. To actuate the tool 10 and drive a fastener into a workpiece, the tool 10 is first placed against the workpiece actuating the safety assembly 48 to allow manual actuation of the trigger assembly 46. Once this occurs, a fluid tube 50 is vented to atmosphere venting a port 52 that vents the area above the poppet 28 allowing the poppet assembly 26 and cylinder 24 to move to the upper position illustrated in FIG. 1. Thereafter, pressurized fluid is introduced above the piston 42 driving it downward within the cylinder 24 to the location illustrated in FIG. 1. As the piston 42 moves downward, air below the piston is compressed and flows beneath the cylinder 24. The compressed air passes through a peripheral opening 56 passage 54 to a chamber 58 defined in the housing 12. In the preferred embodiment illustrated, the chamber 58 is annular in configuration and includes an intersecting tubular passage 60 extending through the chamber 58 and communicating with the atmosphere outside the housing 12.

The muffler 61 of the present invention is positioned within the chamber 58. More specifically, the muffler 61 of the present invention includes a tubular member 62 in which a plurality of openings or apertures 64 are fabricated through the peripheral surface thereof.

In the preferred embodiment illustrated, the tubular muffler element 62 includes a first end 66 that lies in a plane perpendicular to the longitudinal axis of the tubular muffler element 62 and an upper surface 68 that lies at an angle to the axis and both ends are open to the atmosphere. The particular angular configuration of the ends 62 and 68 are of a design to compliment the configuration of the portion of the housing 12 within which the muffler 61 is located. The tubular muffler element 62 is positioned within the passage 60 and maintained therein by roll or dowel pins 70, through hole 71 in element 62 and hole 73 in casing 12.

By using the muffler 61 as described, air compressed by the downward moving piston 42 passes through the opening 56 into the chamber 54 and to chamber 58 encircling the outer periphery of the tubular muffler element 62. The pressurized air or exhaust air then passes through the apertures 64 into the inner peripheral area of the tubular muffler 62. This flow is reverse to that of the typical prior art muffler element wherein the exhaust air is introduced into the inner peripheral region of the muffler and thereafter passes radially outward through the muffler while muffling the noise.

Once the exhaust air has passed into the inner peripheral region of the tubular muffler eleament 62, it may then pass axially out either end 66 or 68 to the atmosphere.

It has been found that the muffler 61 provides a substantial muffling effect of the noise created by the tool 10 during the operation if the apertures 64 are of the proper size; however, if it is desired to muffle the noise further, a second annular muffler element 72 may be included. The second muffler element 72 is annular in configuration and is positioned within the chamber 58 so as to encircle the outer periphery of the tubular muffler element 62. In this configuration, pressurized exhaust air escapes from the chamber 54 into the chamber 58 encircling the outer peripheral surface of the annular muffler element 72. The pressurized exhaust air then passes through the annular muffler element 72 to the outer peripheral surface of the tubular muffler element 62. The pressurized exhaust air continues to flow through the apertures 64, and then flows axially along the length of the muffler element 62 and out either of the ends 66 and 68 to the atmosphere. It has been discovered that this second muffler element 72 further muffles the noise and may be desirable in certain locations that the tool 10 is used such as enclosed areas.

In the preferred embodiment illustrated the annular muffler element 72 may be an acoustical restricting foam that is open celled or reticulated and or it may be fabricated from a wire mesh. In addition, the specific configurations of the muffler elements 62 and 72 are primarily chosen to be circular due to convenience of machining such configurations in the housing 12 of the tool 10, but such configurations are not intended to restrict the configurations of the muffler 61 and the elements 62 and 72 of the present invention.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A muffler for a fastener driving tool wherein said tool includes a housing defining nose and handle portions, a cylinder in said nose portion, said cylinder including upper and lower ends a driver reciprocally mounted in said cylinder, a a chamber defined in said housing in fluid communication with said lower end of said cylinder, said muffler including a first, tubular muffler element mounted in said chamber, said first muffler element including at least one aperture in the periphery thereof.

2. The muffler set forth in claim 1 further comprising a second annular muffler element positioned in said chamber encircling said first muffler element.

3. The muffler set forth in claim 2 wherein said second muffler element is reticulated foam.

4. The muffler set forth in claim 2 wherein said second muffler element is wire mesh.

5. The muffler set forth in claim 1 wherein said chamber includes at least one exhaust port and said first muffler element includes at least one open end in fluid communication with said exhaust port.

6. In a fastener driving tool including a housing defining a nose portion and a handle portion, a driver reciprocally mounted in said nose portion, and means including a piston for driving said driver through a fastener driving stroke, a muffler system comprising:

a chamber defined in said housing including at least one exhaust port;

means for communicating said nose portion beneath said piston with said chamber; and a first muffler element mounted in said chamber, said muffler element defining an inner periphery in communication with said exhaust port.

7. The tool claimed in claim 6 wherein said first muffler element comprises a cylinder with a plurality of openings defined therein.

8. The tool claimed in claim 6 further comprising a second annular muffler element mounted in said chamber surrounding said first muffler element.

9. The tool claimed in claim 8 wherein said second muffler element is reticulated foam.

10. The tool claimed in claim 8 wherein said second muffler element is wire mesh.

11. In a fastener driving tool of the type including a housing defining a nose portion and a handle portion, a cylinder in said nose portion, a driver reciprocally mounted in said cylinder and means for driving said driver through a fastener driving stroke, a muffler for muffling noise produced during a driving stroke comprising:

a chamber defined in said housing, means for communicating a lower end of said cylinder with said chamber, a port in said housing exhausting said chamber to the atmosphere, and a tubular muffler element mounted in said chamber, said tubular muffler element including first and second open ends, said first open end in fluid communication with said port, said tubular muffler element including at least one aperture in the periphery thereof.

12. The tool claimed in claim 11 further comprising an annular muffler element mounted in said chamber surrounding said tubular muffler element.

13. The tool claimed in claim 12 wherein said annular muffler element is reticulated foam.

* * * * *